US008813361B2

(12) United States Patent
Imano et al.

(10) Patent No.: US 8,813,361 B2
(45) Date of Patent: Aug. 26, 2014

(54) GAS TURBINE BLADE AND MANUFACTURING METHOD THEREOF

(75) Inventors: Shinya Imano, Hitachi (JP); Kunihiro Ichikawa, Hitachinaka (JP); Hiroyuki Doi, Tokai (JP); Katsumi Tanaka, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 562 days.

(21) Appl. No.: 13/211,417

(22) Filed: Aug. 17, 2011

(65) Prior Publication Data

US 2011/0296685 A1 Dec. 8, 2011

Related U.S. Application Data

(62) Division of application No. 12/107,796, filed on Apr. 23, 2008, now abandoned.

(30) Foreign Application Priority Data

Apr. 25, 2007 (JP) ..... 2007-115650

(51) Int. Cl.
*B21D 53/78* (2006.01)

(52) U.S. Cl.
USPC ..... 29/889.7; 29/889.1

(58) Field of Classification Search
USPC ..... 29/889, 889.1, 889.2, 889.7, 889.71, 29/889.72
See application file for complete search history.

(56) References Cited

U.S. PATENT DOCUMENTS

| | | | |
|---|---|---|---|
| 6,054,672 | A | 4/2000 | Foster et al. |
| 6,302,649 | B1 | 10/2001 | Mukira |
| 7,547,188 | B2 | 6/2009 | Imano et al. |

FOREIGN PATENT DOCUMENTS

| | | |
|---|---|---|
| EP | 1 090 711 | 4/2001 |
| EP | 1 154 027 | 11/2001 |
| EP | 1 717 326 | 11/2006 |
| JP | 2001-123237 | 5/2001 |
| JP | 2001-159829 | 6/2001 |
| JP | 2006-291344 | 10/2006 |
| WO | WO 97/38144 | 10/1997 |

OTHER PUBLICATIONS

Indian office action of Appln. No. 1022/DEL/2008 dated Aug. 20, 2013 in English.

*Primary Examiner* — Ryan J Walters
(74) *Attorney, Agent, or Firm* — Antonelli, Terry, Stout & Kraus, LLP.

(57) ABSTRACT

In a gas turbine blade where a part of the γ' phase precipitation strengthened type Ni-based alloy base material is composed of a weld metal, the weld metal is a Ni-based alloy containing Ta from 4.8 to 5.3 wt. %, Cr from 18 to 23 wt. %, Co from 12 to 17 wt. %, W from 14 to 18 wt. %, C from 0.03 to 0.1 wt. %, Mo from 1 to 2 wt. %, and Al of 1 wt. % or less, in which the oxygen content is 0 to 30 ppm, the Ti content from 0 to 0.1 wt. %, and the Re content from 0 to 0.5 wt. %. A blade base metal is manufactured by the step of stripping, the step of solution heat treatment where the γ' phase is dissolved again, the step of welding in an inert gas chamber by a TIG method using a welding wire where the weld metal can be obtained, the step of HIP treatment at 1100° C. to 1150° C., and the step of an aging treatment at 835° C. to 855° C.

10 Claims, 5 Drawing Sheets

GAS TURBINE BLADE AND MANUFACTURING METHOD THEREOF

CROSS-REFERENCE TO RELATED APPLICATION

This application is a divisional application of U.S. application Ser. No. 12/107,796, filed Apr. 23, 2008, now abandoned the contents of which are incorporated herein by reference.

CLAIM OF PRIORITY

The present application claims priority from Japanese application Serial No. 2007-115650, filed on Apr. 25, 2007, the content of which is hereby incorporated by reference into this application.

FIELD OF THE INVENTION

The present invention relates to a gas turbine blade and a manufacturing method thereof. A gas turbine blade of the present invention is preferable for a turbine blade of an industrial gas turbine. Moreover, although the matter of concern is a weld repaired blade where the weld repair is applied mainly after damage, it can be applied to one where the high temperature and high stress part is previously composed of a weld metal even if it is a new blade.

RELATED ART

Since the gas turbine blade is exposed to a temperature of 1000° C. or more, spalling such as fatigue cracks and oxidation thickness reduction, etc. are created. A blade, which is damaged is abandoned or reused after repair.

A gas turbine blade is a precision casting and three types exist, which are an equiaxed crystal, a unidirectionally solidified crystal, and a single crystal, and the material thereof is a γ' phase precipitation strengthened type Ni-based superalloy. The γ' phase is an intermetallic compound containing $Ni_3Al$ and the γ' phase precipitation strengthened type Ni-based superalloy has extremely high high-temperature strength because it has a unique feature where the strength increases with increasing temperature. Moreover, since it has a dendritic structure peculiar to a cast structure, a morphology is obtained in which crystal grain boundaries become complicated even if it is an equiaxed crystal and a unidirectionally solidified crystal, so that the grain boundary strength is high, and crack resistance and fatigue strength are extremely high.

Thus, a γ' phase precipitation strengthened type Ni-based superalloy used for the gas turbine blade has excellent high temperature strength, but it is difficult to weld and to be repaired by welding because ductility at high temperatures and low temperatures is small and workability and weldability are not good.

However, weld repair has become possible by improving the welding technique and by developing a welding material having strength and excellent weldability. The welding material is classified as powder material and wire material. The wire material has good workability and good yield. However, since the wire material is manufactured by hot working and cold drawing, a high strength material having bad workability cannot be used. Since the powder material is manufactured by quenching a sprayed liquid phase, a high strength material having bad workability can be used. However, since the total surface area of the material is large, the amount of gas composition mixed by oxidation or adsorption during the welding process is large compared with the wire material, resulting in sufficient oxidation resistance and fatigue strength being not obtained.

Patent documents 1 to 3 disclose weld materials for weld repairing gas turbine blades. As described above, the gas turbine blade material is a γ' phase precipitation strengthened type superalloy. However, the ductility at high temperatures and low temperatures is small and workability and weldability are not good, so that a solid solution strengthened type alloy, not a γ' phase precipitation strengthened type alloy, in which a lot of fire resistant elements such as Mo, W, Ta, and Nb are added are used in these well-known examples. In patent example 2, excellent high temperature strength characteristics are made to coexist with workability and weldability by making the total amount of the fire resistant elements 15 to 28 wt. %. Patent document 1 discloses no total amount of the fire resistant elements but appropriate additions of W, Mo, and Ta are provided, respectively. Moreover, Mo is not added therein and the addition of Ta is increased accordingly. Any of patent documents 1 to 3 disclose that the addition of Al is decreased in order to decrease precipitation of the γ' phase. However, Al is an element, which greatly contributes to the improvement of oxidation resistance of the superalloy and deterioration of oxidation resistance occurs with a decrease in Al, so that Mn and Si are appropriately added to compensate. In order to keep the grain boundaries from nitriding at high temperatures, it has been described that a decrease in Al is necessary.

Since micro-defects such as porosity and blowholes are produced, a HIP treatment is performed in order to eliminate them. A HIP treatment is one which adds an isotropic high pressure at a high temperature and, in the case of a gas turbine blade material, it is typically performed at a temperature from 1160° C. to 1200° C. where the γ' phase is dissolved.

[Patent Document 1] JP-A No. 2001-123237
[Patent Document 2] JP-A No. 2001-158929
[Patent Document 3] JP-A No. 2006-291344

SUMMARY OF THE INVENTION

It is difficult for the weld material to obtain a strength equal to that of the blade material because of the mixing of gaseous components during the welding process and the difference of alloy components according to importance placed on weldability and workability. Specifically, when the amount of mixed oxygen is great, the oxidation resistance deteriorates considerably. Moreover, there is not only the difference between the gas component and the alloy component but also differences of the solidification structure caused by differences in the solidification rate.

The blade material is slowly solidified in the mold because it is a precision casting but, compared with this, the cooling rate of the weld material during solidification becomes considerably higher. Specifically, C is condensed in the liquid phase during solidification and segregates to the grain boundaries, which are the final parts to solidify, resulting in a high proportion of carbide being formed at the grain boundaries. Carbide precipitated at the grain boundaries pins the grain boundaries and works to prevent the grain boundaries from moving, so that grain boundary migration does not occur by performing the HIP treatment in the blade material where the solidification rate is low and grain boundary segregation is great and the dendritic structure during solidification is maintained. Not only carbide but also eutectic γ' phase and a metal having a high melting point which is segregated to the grain boundaries works for preventing grain boundary migration.

On the other hand, since the weld material has a larger solidification rate, segregation is small and, since the amount of carbide formed at the grain boundaries is small, the grain boundaries are easily moved by the HIP treatment and the dendritic structure is aligned. Accordingly, the grain boundary strength is decreased, resulting in high temperature durability, fatigue strength, and the crack resistance being decreased.

It is an objective of the present invention to provide a welded part having better fatigue properties and crack resistance than that of the prior art by suppressing grain boundary alignment of the weld metal in a turbine blade where the weld repaired part or the high temperature high stress part is composed of a weld metal.

The present invention provides a gas turbine blade where a part of the blade base material composed of a γ' phase precipitation strengthened type Ni-based superalloy includes a weld metal, in which the weld metal comprises a Ni-based alloy containing Ta from 4.8 to 5.3 wt. %, Cr from 18 to 23 wt. %, Co from 12 to 17 wt. %, W from 14 to 18 wt. %, C from 0.03 to 0.1 wt. %, Mo from 1 to 2 wt. %, and Al of 1 wt. % or less and in which the oxygen content is 0 to 30 ppm, the Ti content 0 to 0.1 wt. %, and the Re content 0 to 0.5 wt. %.

Figure 1:
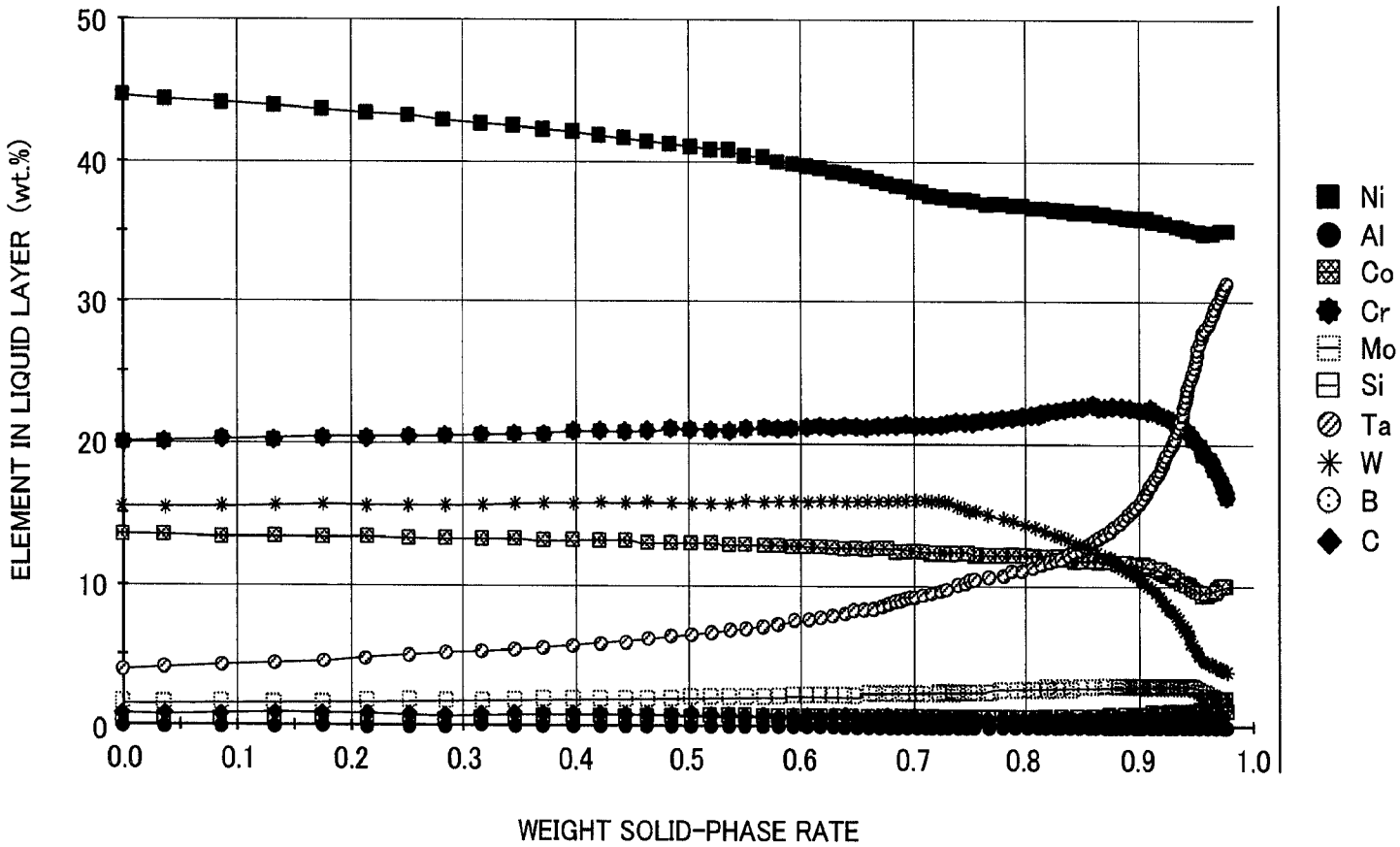
FIG. 1 shows plots of the liquid phase concentration during equilibrium solidification.

Description of Reference Numerals: 101: oxidation reduced thickness part, 102: weld repaired part

DETAILED DESCRIPTION OF THE PREFERRED EMBODIMENTS

One aspect of the present invention provides a gas turbine blade where a part of the blade base material composed of a γ' phase precipitation strengthened type Ni-based superalloy is composed of a solid solution strengthened type Ni-based alloy, in which the weld metal comprises a Ni-based alloy containing Ta from 4.8 to 5.3 wt. %, Cr from 18 to 23 wt %, Co from 12 to 17 wt %, W from 14 to 18 wt %, C from 0.03 to 0.1 wt %, Mo from 1 to 2 wt. %, Al of 1 wt % or less, in which the oxygen content is 0 to 30 ppm, the Ti content 0 to 0.1 wt. %, the Re content 0 to 0.5 wt. %, and in which the boundary between the blade base material and the weld metal comprises a mixture of the γ' phase precipitation strengthened type Ni-based superalloy and the weld metal.

Another aspect of the present invention provides a method for manufacturing a gas turbine blade where a part of the blade base material composed of a γ' phase precipitation strengthened type Ni-based superalloy is composed of a weld metal, in which a step of stripping the blade base material, a step of applying a solution heat treatment in which the γ' phase of the blade base material is dissolved again, a step of welding to form the part composed of the weld metal by welding in an inert gas chamber using a TIG method which uses a welding wire composed of a Ni-base material containing Ta from 4.8 to 5.3 wt. %, Cr from 18 to 23 wt %, Co from 12 to 17 wt %, W from 14 to 18 wt. %, C from 0.03 to 0.1 wt. %, Mo from 1 to 2 wt. % and Al of 1 wt % or less, where the oxygen content is 0 to 30 ppm, the Ti content 0 to 0.1 wt. %, the Re content 0 to 0.5 wt. %, a step of applying a HIP treatment in which a HIP treatment is performed at a temperature from 1100 to 1150° C. after the welding step, and a step of applying an aging treatment in which an aging treatment is performed at a temperature from 835 to 855° C. after the step thereafter are included.

Still another aspect of the present invention provides a method for manufacturing a gas turbine blade where a part of the blade base material composed of a γ' phase precipitation strengthened type Ni-based superalloy is composed of a weld metal, in which a step of welding to form the part composed of the weld metal by welding in an inert gas chamber using a TIG method which uses a welding wire composed of a Ni-base material containing Ta from 4.8 to 5.3 wt. %, Cr from 18 to 23 wt %, Co from 12 to 17 wt %, W from 14 to 18 wt. %, C from 0.03 to 0.1 wt. %, Mo from 1 to 2 wt. % and Al of 1 wt % or less, where the oxygen content is 0 to 30 ppm, the Ti content 0 to 0.1 wt. %, the Re content 0 to 0.5 wt. %, a step of applying a HIP treatment in which a HIP treatment is performed at a temperature from 1100 to 1150° C. after the welding step, and a step of applying an aging treatment in which an aging treatment is performed at a temperature from 835 to 855° C. after the step thereafter are included.

A further aspect of the present invention provides a welding wire for the weld metal of a gas turbine blade of the present invention and in a method for manufacturing the gas turbine blade of the present invention may contain Al from 0.25 to 1 wt. %, Si from 0.15 to 0.35 wt. %, and Mn from 0.4 to 2 wt. %. As a result, the oxidation resistance of the welded part can be improved.

In an example of a gas turbine blade of the present invention, the weld repaired part is formed of a weld metal. Moreover, in another example, the part exposed to high temperatures and high stresses includes the aforementioned weld metal in a new turbine blade.

In a method for manufacturing a gas turbine blade of the present invention, the solution heat treatment is performed at a temperature not lower than the solid-solution temperature of the γ' phase and not higher than the partial melting temperature.

Moreover, in a method for manufacturing a gas turbine blade of the present invention, it is preferable that a coating film formed over the surface of the gas turbine blade be peeled off before welding.

According to embodiments of the present invention, a gas turbine blade can be obtained where alignment of the grain boundaries is suppressed and which has a welded part having excellent fatigue strength and oxidation resistance characteristics.

FIG. 1 is a figure where the liquid phase concentration during equilibrium solidification of the chemical components of a weld material described in patent document 1 is calculated by using a CALPHAD method and the calculated values are plotted. Since Mo and W preferentially come into the solid phase as solidification proceeds, that is, increasing the solid phase fraction, the concentration in the liquid layer decreases. As a result, Mo and W hardly segregate to the grain boundaries. On the other hand, since Ta is concentrated in the liquid layer as solidification proceeds, it is an element which is segregated to the grain boundaries and is effective in suppressing alignment of the grain boundaries.

Although patent document 2 provides the sum total of the heat resistant elements, Mo and W have a totally different segregation behavior from Ta, so that each addition has to be provided independently.

In order to suppress alignment of the grain boundaries, it is necessary to add Ta of 4.8 wt. % or more. However, when the addition exceeds 5.3 wt. %, workability becomes worse and making wire becomes difficult.

Mo and W are important for increasing the strength, and it is necessary to add Mo from 1 to 2 wt. % and W from 14 to 16 wt. %. Although any element contributes to improvement in the intracrystalline strength, a harmful phase is produced when too much is added, resulting in the ductility thereof being decreased.

From the viewpoint of suppressing grain nitride cracking and suppressing precipitation of the γ' phase, the addition of Al is necessary to be 1 wt % or less, specifically, it is preferable to be 0.75 wt. % or less. In order to maintain the oxidation resistance, it is preferable that Si from 0.15 to 0.35 wt. %, Mn from 0.4 wt % to 2 wt. %, and Cr from 18 to 23 wt. % are added in addition to Al of 0.35 wt. % or more, and that the oxygen content after welding be made small as much as possible, preferably, 0 to 30 ppm. Si, Mn, and Cr increase the oxidation resistance but they make the material brittle when they are added in excess.

Although it is necessary to add Co of 12 wt. % or more in order to expand the solid solubility limit of Cr, it is necessary to make it 17 wt. % or less because the material becomes brittle because a specific harmful phase is produced when they are added in excess.

It is preferable that the content of Ti be made smaller to be 0 to 0.1 wt. % because the weld material is not a precipitation strengthened type.

The Re content is preferably controlled to be 0 to 0.5 wt. %.

Figure 2:
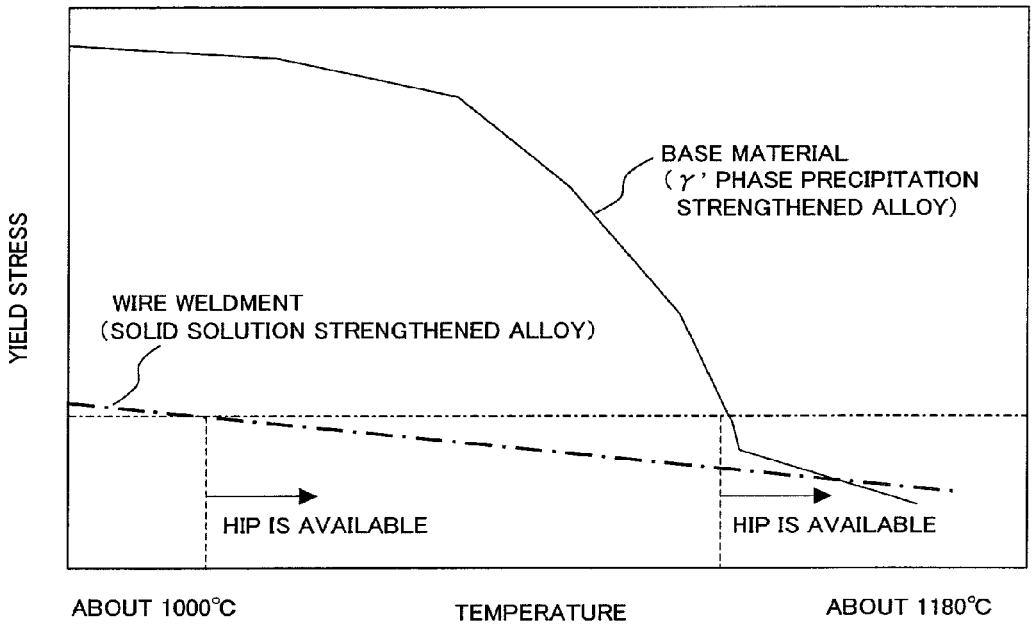
FIG. 2 is the temperature dependencies of the strength.

FIG. 2 schematically shows the temperature dependences of the strength of a solid solution strengthened type alloy and a γ' phase precipitation strengthened type alloy. Although the γ' phase precipitation strengthened type has high strength up to the temperatures where the γ' phase is soluble, the strength thereof rapidly decreases at temperatures higher than this. In order to eliminate defects, it is necessary to perform a HIP treatment at a temperature where the strength becomes smaller. IN738 and Rene80 which are widely used as a gas turbine blade have a γ' solution temperature of about 1160° C., so that the HIP treatment is generally performed at 1160° C. or more.

The solid solution strengthened type alloy has a small temperature dependence of the strength as shown in FIG. 2 and the strength thereof is smaller than that of a γ' phase precipitation strengthened type alloy at about 1100° C. However, if it is exposed to high temperatures, the strength does not decrease as much. On the other hand, the alignment of the grain boundaries is accelerated with temperature, so that it is necessary to make the HIP temperature 1150° C. or less in order to suppress the alignment of the grain boundaries of the solid solution strengthened type alloy. If it becomes lower than 1100° C., the defect is hardly crushed. If the welding condition is optimized, weld cracks do not occur and the defects are blowholes and micro-porosities. Since these defects are produced in the weld metal which is a solid solution strengthened type alloy, the HIP temperature should be 1150° C. or less and 1100° C. or more. A HIP treatment not lower than the solid solution temperature of the γ' phase has the effect where a grown or flattened γ' phase is dissolved again and reprecipitated to recover the damage of the base material.

When the HIP temperature is controlled to be 1150° C. or less and 1100° C. or more, the γ' phase is not dissolved again and there is no damage recovery effect of the base material. Therefore, in the present invention, it is preferable that a solution heat treatment of the γ' phase be performed before weld repair. However, if the damage of the base material is small, the solution heat treatment can be omitted.

If a HIP treatment is performed, an aging treatment is performed for mainly improving the strength of the base material. The aging treatment temperature is preferably 835° C. to 855° C. which is suitable for controlling the grain size and morphology of the precipitate.

According to the selection of the weld metal element and the manufacturing method thereof as mentioned above, the alignment of the grain boundaries is improved, resulting in the fatigue strength being widely improved.

Figure 7:
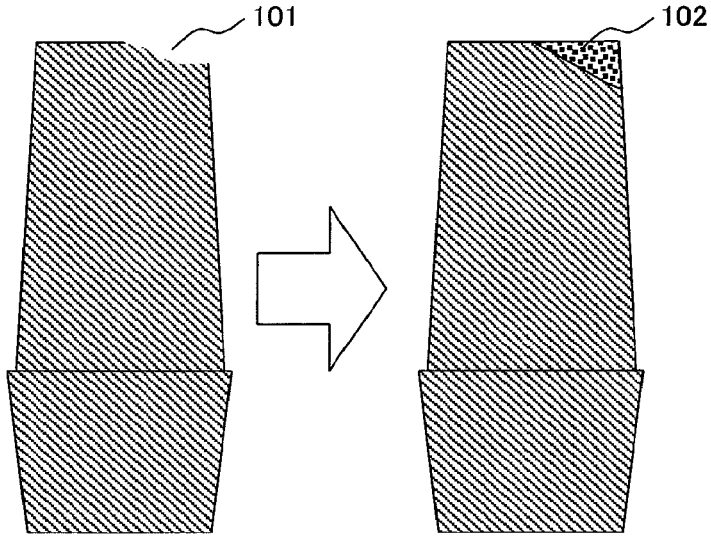
FIG. 7 is a schematic drawing illustrating a weld repaired part of a gas turbine blade.

FIG. 7 is an example of a weld repaired blade. It is one where the oxidation reduced thickness part 101 where a reduced thickness produced by oxidation is repaired by using the weld repaired part 102 of the present invention.

[Embodiment 1]

An alloy having the chemical composition as shown in table 1 was manufactured by using a vacuum melting technique and processed to a wire of about 2 mm by hot forging and cold drawing. Using this, the weld metal is formed over the blade base material by a TIG welding method and a test piece is taken to perform various evaluations.

Table 2 shows the weld material (welding wire) which is used, the weld repair process, welding atmosphere, the oxygen content, and morphology of the obtained weld metal.

TABLE 1

Chemical analysis of the test sample

| Major element | Comparative material | | | | | Invention material | | |
|---|---|---|---|---|---|---|---|---|
| (wt. %) | 1 | 2 | 3 | 4 | 5 | 1 | 2 | 3 |
| Al | 3.5 | 1.2 | 0.3 | 0.6 | 1.2 | 0.6 | 0.4 | 0.5 |
| Co | 2 | 2 | 2 | 12 | 14 | 14 | 12 | 13 |
| Mn | 0.7 | 0.7 | 0.7 | 0.7 | 0.7 | 0.7 | 0.6 | 0.7 |
| Si | 0.2 | 0.2 | 0.2 | 0.2 | 0.2 | 0.2 | 0.2 | 0.2 |
| Cr | 20 | 20 | 20 | 20 | 20 | 20 | 19 | 21 |
| Mo | 0 | 0 | 0 | 1.8 | 0 | 1.5 | 1.5 | 1.8 |
| Ta | 0 | 0 | 0 | 4 | 4.5 | 5 | 4.9 | 5.2 |
| W | 18 | 22 | 20 | 15 | 18 | 18 | 15 | 15 |
| C | 0.09 | 0.09 | 0.04 | 0.04 | 0.09 | 0.09 | 0.06 | 0.07 |

TABLE 2

Weld repair process and morphology

Figure 3A:
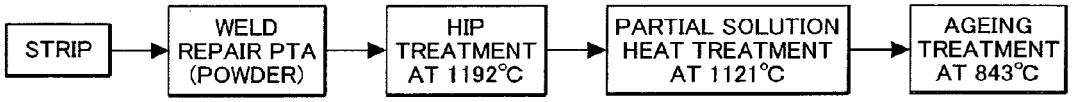
FIG. 3 shows weld repair processes of a conventional method and a method of the present invention.
Figure 3B:
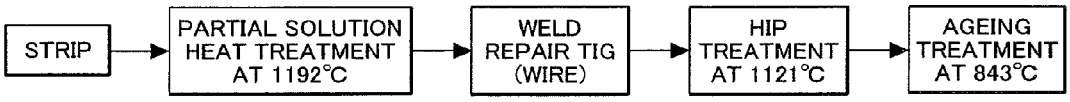
Figure 4A:
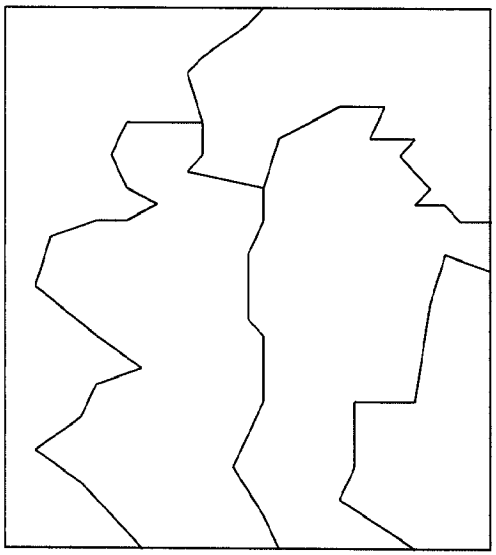
FIG. 4 are schematic drawings of morphologies of a weld metal.
Figure 4B:
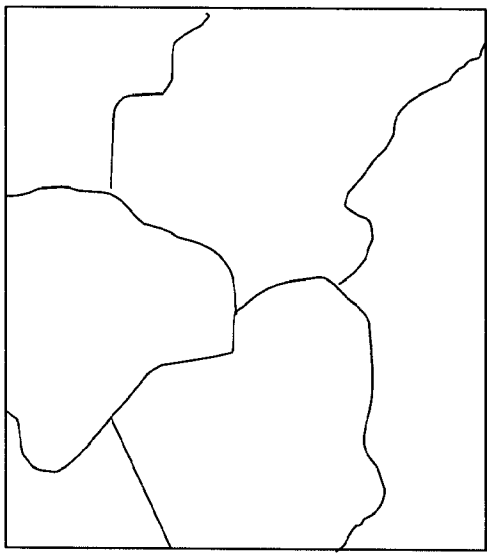
Figure 4C:
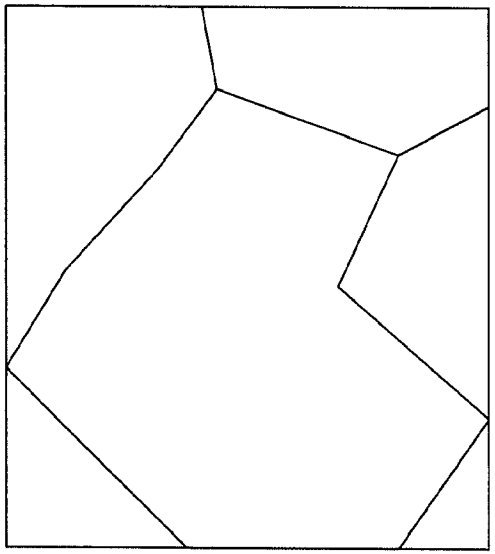

| | Weld material | Weld repair process | Welding atmosphere | Oxygen content | Morphology |
|---|---|---|---|---|---|
| Comparative example A | Comparative material 1 | FIG. 3(a) | Inert gas Chamber | 12 ppm | FIG. 4(c) |
| Comparative example B | Comparative material 2 | FIG. 3(a) | Inert gas Chamber | 15 ppm | FIG. 4(c) |
| Comparative example C | Material of the invention 1 | FIG. 3(a) | Inert gas Chamber | 20 ppm | FIG. 4(c) |
| Comparative example D | Material of the invention 1 | FIG. 3(a) | In atmosphere | 45 ppm | FIG. 4(b) |
| This invention A | Material of the invention 1 | FIG. 3(b) | Inert gas Chamber | 10 ppm | FIG. 4(a) |
| This invention B | Material of the invention 2 | FIG. 3(b) | Inert gas Chamber | 12 ppm | FIG. 4(a) |
| This invention C | Material of the invention 3 | FIG. 3(b) | Inert gas Chamber | 15 ppm | FIG. 4(a) |

The weld repair process is as shown in FIG. 3. (a) is a conventional method and (b) is a method of the present invention.

FIG. 4 is a schematic drawing illustrating morphology of the weld metal obtained in this embodiment. Herein, (a) is one where the alignment of the crystal grain boundaries is suppressed and a dendritic structure develops. (b) is one where the dendritic structure is deformed and alignment progresses. (c) is one where the grain boundaries are aligned.

In A to C of the present invention, all of them have the structure shown in FIG. 4(*a*) and alignment of the crystal grain boundaries is suppressed. Including more Ta and making the HIP treatment temperature lower than the prior art contribute to this.

Figure 5:
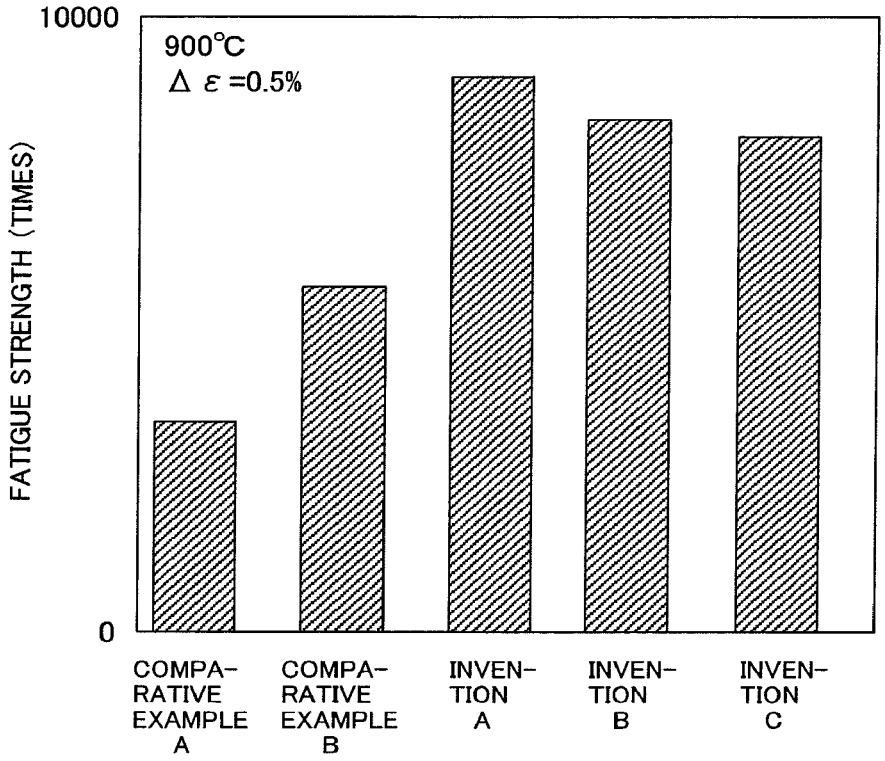
FIG. 5 shows high temperature fatigue characteristics.

FIG. 5 shows results of high temperature fatigue tests of materials of this invention and a comparative example. The vertical line shows the frequency at fracture in the fatigue test. The material of this invention has a considerably high fatigue strength compared with that of a conventional material. As shown in Table 2, this is an effect where the alignment of the grain boundaries is suppressed.

Figure 6:
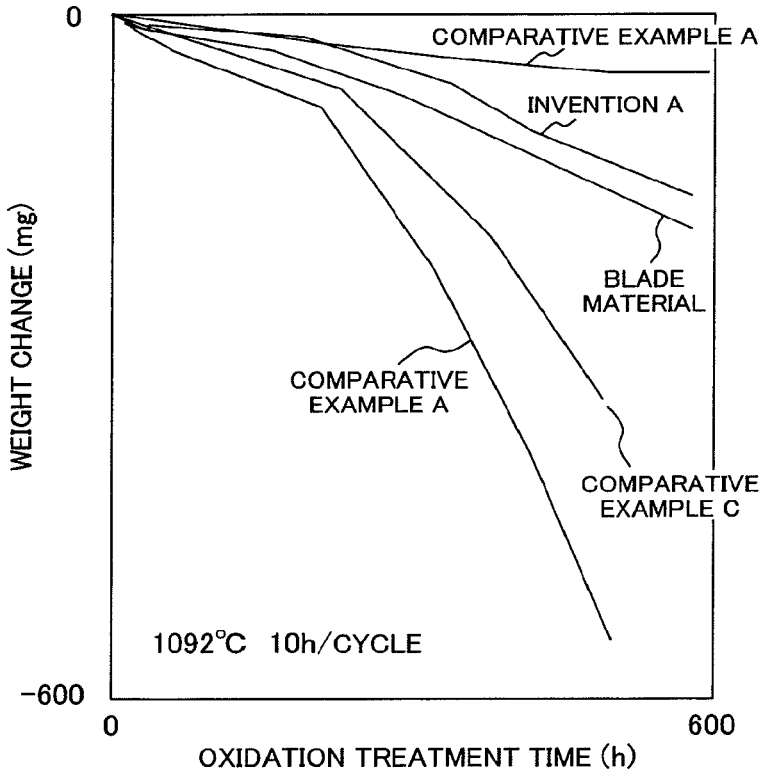
FIG. 6 shows high temperature oxidation resistance characteristics.

FIG. 6 shows the oxidation resistance test results which are performed by using samples which contain different oxygen contents. It was confirmed that the oxidation resistance of the material of the invention compares favorably with the prior art.

What is claimed is:

1. A method for manufacturing a gas turbine blade in which a part of the blade base material composed of a γ' phase precipitation strengthened type Ni-based superalloy, comprising the steps of:

stripping said blade base material;

applying a solution heat treatment in which the γ' phase of said blade base material is dissolved;

welding to form the part composed of a weld metal by welding in an inert gas chamber using a TIG method which uses a welding wire composed of a Ni-base material containing Ta from 4.8 to 5.3 wt. %, Cr from 18 to 23 wt %, Co from 12 to 17 wt %, W from 14 to 18 wt. %, C from 0.03 to 0.1 wt. %, Mo from 1 to 2 wt. % and Al from 1 wt % or less, in which an oxygen content is 0 to 30 ppm, a Ti content is 0 to 0.1 wt. %, and a Re content is 0 to 0.5 wt. %;

applying a HIP treatment in which the HIP treatment is performed at a temperature from 1100 to 1150° C. after said welding step; and applying an aging treatment in which the aging treatment is performed at a temperature from 835 to 855° C. after the HIP treatment.

2. The gas turbine blade according to claim 1, wherein the part composed of said weld metal is a weld repaired part.

3. The gas turbine blade according to claim 1, wherein the part of said gas turbine blade exposed to high temperature and high stress is previously composed of said weld metal.

4. The gas turbine blade according to claim 1, wherein said solution heat treatment is performed at a temperature not lower than the solid-solution temperature of the γ' phase and not higher than the partial melting temperature.

5. The gas turbine blade according to claim 1, wherein the step of stripping said gas turbine blade is a treatment in which a coating film formed over the surface of the gas turbine blade is peeled off.

6. The gas turbine blade according to claim 1, wherein said welding wire contains Al from 0.25 to 1 wt. %, Si from 0.15 to 0.35 wt. %, and Mn from 0.4 to 2 wt. %.

7. A method for manufacturing a gas turbine blade in which a part of the blade base material composed of a γ' phase precipitation strengthened type Ni-based superalloy, comprising the steps of:

welding to form the part composed of a weld metal by welding in an inert gas chamber using a TIG method which uses a welding wire composed of a Ni-base material containing Ta from 4.8 to 5.3 wt. %, Cr from 18 to 23 wt %, Co from 12 to 17 wt %, W from 14 to 18 wt. %, C from 0.03 to 0.1 wt. %, Mo from 1 to 2 wt. % and Al from 1 wt % or less, in which an oxygen content is 0 to 30 ppm, a Ti content is 0 to 0.1 wt. %, and a Re content is 0 to 0.5 wt. %;

applying a HIP treatment in which the HIP treatment is performed at a temperature from 1100 to 1150° C. after said welding step; and applying an aging treatment in which the aging treatment is performed at a temperature from 835 to 855° C. after the HIP treatment.

8. The gas turbine blade according to claim 7, wherein the part composed of said weld metal is a weld repaired part.

9. The gas turbine blade according to claim 7, wherein the part of said gas turbine blade exposed to high temperature and high stress is previously composed of said weld metal.

10. The gas turbine blade according to claim 7, wherein said weld wire contains Al from 0.25 to 1 wt. %, Si from 0.15 to 0.35 wt. %, and Mn from 0.4 to 2 wt. %.

* * * * *